United States Patent [19]

Coulon et al.

[11] Patent Number: 4,839,237

[45] Date of Patent: Jun. 13, 1989

[54] METHOD OF LAYING A COBALT-CHROMIUM-TUNGSTEN PROTECTIVE COATING ON A BLADE MADE OF A TUNGSTEN ALLOY INCLUDING VANADIUM, AND A BLADE COATED THEREBY

[75] Inventors: André Coulon, Bessoncourt; Ulrich Bech, Buochs, both of France

[73] Assignee: Alsthom, France

[21] Appl. No.: 54,963

[22] Filed: May 28, 1987

[30] Foreign Application Priority Data

May 28, 1986 [FR] France ..... 86 07662

[51] Int. Cl.[4] ..... B32B 15/04; C23C 10/30

[52] U.S. Cl. ..... 428/610; 428/661; 427/205

[58] Field of Search ..... 428/662, 660, 661, 666, 428/668, 665, 610; 427/191, 201, 205, 405, 46

[56] References Cited

U.S. PATENT DOCUMENTS

| | | | |
|---|---|---|---|
| 2,612,442 | 9/1952 | Goetzel | 428/660 |
| 2,763,919 | 9/1956 | Kempe et al. | 428/661 |
| 2,854,739 | 10/1958 | Bartlett et al. | 428/661 |
| 3,015,880 | 1/1962 | Stephenson | 427/191 |
| 3,060,557 | 10/1962 | Rostoker et al. | 428/661 |
| 3,471,342 | 10/1969 | Wood | 428/661 |
| 4,137,370 | 1/1979 | Fujishiro et al. | 428/660 |
| 4,305,998 | 12/1981 | Manty et al. | 428/661 |

FOREIGN PATENT DOCUMENTS

| | | | |
|---|---|---|---|
| 0094759 | 11/1983 | European Pat. Off. . | |
| 188057 | 7/1986 | European Pat. Off. | 428/660 |
| 128256 | 7/1985 | Japan | 428/660 |
| 941089 | 11/1963 | United Kingdom | 427/191 |
| 1479855 | 7/1977 | United Kingdom . | |
| 2005302 | 4/1979 | United Kingdom . | |

*Primary Examiner*—John J. Zimmerman

*Attorney, Agent, or Firm*—Sughrue, Mion, Zinn, Macpeak and Seas

[57] ABSTRACT

A method of laying a protective coating on a blade (1) made of a titanium alloy including vanadium. Vanadium powder is deposited on the portion of the blade (1) to be coated, the temperature of the powder is then raised to a temperature slightly greater than the melting point of vanadium. A powder of a cobalt-chromium-tungsten alloy is then deposited on the layer of vanadium, and this powder is raised to a temperature greater than its melting temperature and less than the melting temperature of vanadium. A blade made of an alloy of titanium including vanadium is characterized in that the blade includes a coating layer (5) of cobalt-chromium-tungsten alloy at its periphery, said layer being at least 1 mm thick and covering an underlayer of vanadium (6) which has a thickness lying in the range 0.5 mm to 1.5 mm. The resulting blade has very high resistance to abrasion by water droplets.

7 Claims, 1 Drawing Sheet

METHOD OF LAYING A COBALT-CHROMIUM-TUNGSTEN PROTECTIVE COATING ON A BLADE MADE OF A TUNGSTEN ALLOY INCLUDING VANADIUM, AND A BLADE COATED THEREBY

The present invention relates to a method of laying a protective coating on a blade made of a titanium alloy including vanadium, and to a blade coated thereby.

BACKGROUND OF THE INVENTION

Titanium alloy blades have the advantage of a high strength/density ratio and also of remarkable mechanical performance in highly corrosive mediums.

However, titanium alloy blades used in steam turbines, particularly when their peripheral speeds are high, are rapidly damaged by the droplets of water which form the steam.

It is therefore necessary to protect the peripheries of such blades.

SUMMARY OF THE INVENTION

The present invention provides a blade made of a titanium alloy including vanadium which also includes at its periphery a coating layer made of a cobalt-chromium-tungsten alloy which is at least 1 mm thick and which covers an underlayer of vanadium having a thickness lying in the range of 0.5 mm to 1.5 mm.

This coating is laid as follows: vanadium powder is placed on the portion of the blade to be coated, then the temperature of the powder is raised to a temperature which is slightly greater than the melting point of vanadium.

Thereafter, powdered cobalt-chromium-tungsten alloy is placed on the layer of vanadium and said powder is raised to a temperature greater than its melting temperature and less than the melting temperature of vanadium.

By virtue of this method, a minimum quantity of the vanadium is diluted in the titanium alloy blade during the first step. Similarly, during the second step, the dilution of the cobalt-chromium-tungsten alloy in the underlayer of vanadium is very limited. Further, the melting of this alloy layer has no effect on the bond already provided between the underlayer of vanadium and the blade.

In order to limit these dilutions as much as possible, it is preferable to use inductive heating provided by a moving inductor.

BRIEF DESCRIPTION OF THE DRAWING

An implementation of the invention is described by way of example with reference to the accompanying drawing, in which.

Figure 1:
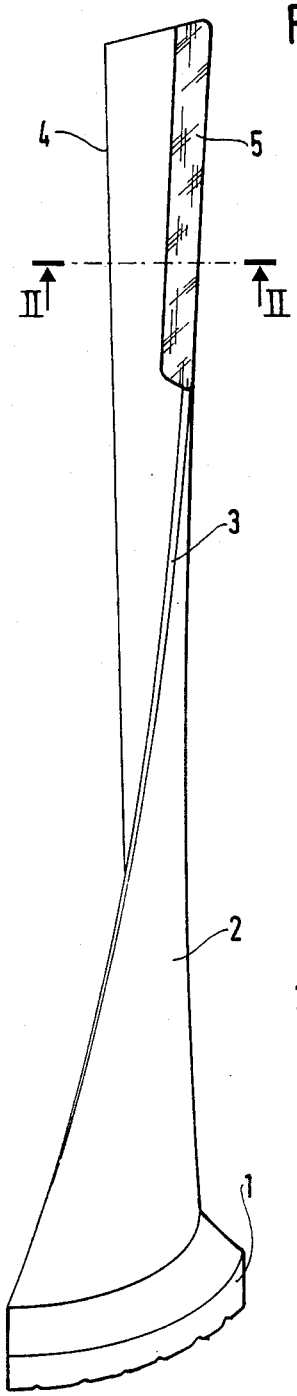
FIG. 1 is a perspective view of a blade in accordance with the invention.
Figure 2:
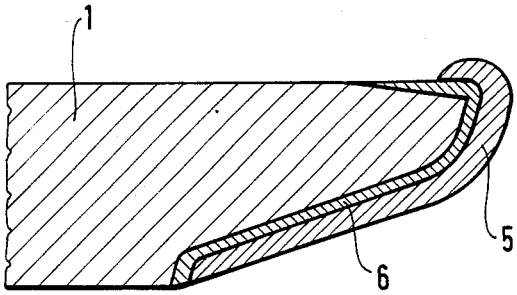
FIG. 2 is a section through the FIG. 1 blade.

The steam turbine blade shown in FIG. 1 comprises a root 1 and a twisted vane 2 having a leading edge 3 and a trailing edge 4. A layer of protective coating 5 has been laid over the top portion of the blade along its leading edge 3 and over its convex face. This coating layer extends over about at least one-third of the width of the blade 2. An underlayer of vanadium 6 (see FIG. 2) is placed between the blade and its coating.

The blade is made of a titanium alloy including 6% aluminum and between 3.5% and 4.5% vanadium.

The method of laying the protective coating is as follows:

The surface of the blade to be coated is prepared in conventional manner and then practically pure (>90%) vanadium powder of small mesh size and mixed with a binder is placed on said surface. The quantity used is sufficient to ensure that the final thickness of the underlayer 6 of vanadium is greater than 1 mm. The blade is put into a high-frequency induction oven having a moving inductor. The oven is a vacuum oven or an inert atmosphere oven, the oven environment is preheated and then the layer of vanadium is heated by means of a 30 mm diameter spot by maintaining the spot stationary from 20 to 75 seconds and then moving on in 20 mm steps.

Figure 3:
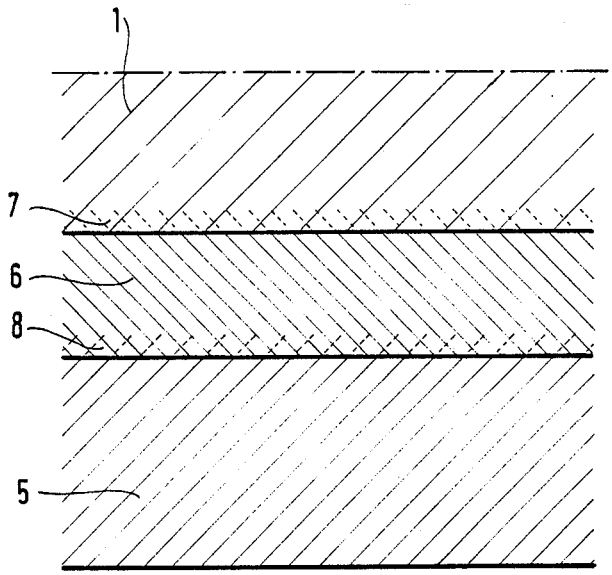
FIG. 3 is a fragmentary view of the FIG. 2 section.

The temperature is raised locally to between 1950° C. and 2000° C. The melting temperature of vanadium is 1900° C. and the melting temperature of the titanium alloy is about 2400° C. As a result, the vanadium is melted while the titanium alloy substrate is softened, thereby providing ideal conditions for maximum binding with the low dilution of vanadium into the substrate. The titanium alloy which includes about 4% vanadium can tolerate a limited quantity of vanadium by dilution (see FIG. 3) giving rise locally to a beta structure. The thickness of the layer 7 of the alloy into which vanadium is diluted is very small (<1/10 mm).

After sweeping over the entire area of vanadium, the temperature of the oven is allowed to drop down to ambient.

Powdered cobalt-chromium-tungsten alloy associated with a binder is then placed on the vanadium underlayer.

This powder is placed up to 3 mm to 4 mm from the edges of the vanadium underlayer in order to ensure that there is never any direct contact between the cobalt-chromium-tungsten alloy and the titanium alloy substrate.

A second cycle is then begun in the oven under an inert atmosphere or under a vacuum with the layer of alloy being spot heated to a temperature which is 50° C. greater than the melting temperature of the cobalt-chromium-tungsten alloy (1200° C. to 1500° C.). Since this temperature is much less than the melting temperature of vanadium, only very little cobalt-chromium-tungsten alloy is diluted in the vanadium (see FIG. 3), and the vanadium to substrate bond is maintained intact, with the layer 8 of vanadium including diluted cobalt-chromium-tungsten alloy being very thin (<1/10 mm).

This layer of deposited alloy is about 1.5 mm thick.

After returning the oven temperature to ambient, conventional stress-relieving treatment is performed at about 700° C.

We claim:

1. A steam turbine blade made of an alloy of titanium including vanadium, the improvement wherein the titanium alloy blade includes a coating layer of cobalt-chromium-tungsten alloy over a portion of the blade to be protected, said coating layer being at least 1 mm thick and an underlayer of vanadium of a thickness in the range of 0.5 mm to 1.5 mm with diffusion bonding of the vanadium underlayer to the titanium alloy blade and the coating layer to the vanadium underlayer to the extent of low dilution of the vanadium into the titanium alloy blade giving rise locally to a beta structure at the interface therebetween and wherein the dilution of the cobalt-chromium-tungsten alloy into the underlayer of vanadium is sufficiently limited such that no adverse effect occurs on the bond between the underlayer of vanadium and the titanium alloy blade with the steam turbine blade having very high resistance to abrasion by water droplets under steam turbine operating conditions wherein the blade operates at high peripheral speed.

2. A steam turbine blade made of a titanium alloy including vanadium by the method comprising the following steps in sequence:

depositing practially pure vanadium powder on a portion of said blade to be protected;

raising the temperature of the powder to a temperature slightly greater than the melting point of vanadium;

dropping the temperature;

depositing a powder of a cobalt-chromium-tungsten alloy on the layer of vanadium; and raising said powder of cobalt-chromium-tungsten alloy to a temperature greater than its melting temperature and less than the melting temperature of the layer of vanadium whereby maximum binding of the protective layer of vanadium to the titanium alloy blade occurs with low dilution from vanadium protective layer into the titanium alloy blade substrate giving rise locally to a beta structure at the interface therebetween and wherein the dilution of the cobalt-chromium-tungsten alloy into the layer of vanadium is sufficiently limited so that no adverse effect on the bond between the layer of vanadium and the blade in the titanium alloy blade substrate occurs with the resulting blade having very high resistance to abrasion by water droplets under steam turbine operating conditions with the blade operating at high peripheral speed.

3. The blade according to claim 2, wherein the step of raising the temperature of the vanadium and of the cobalt-chromium-tungsten alloy is effected by induction heating using a moving inductor.

4. The blade according to with claim 2, wherein the quantities of vanadium powder and cobalt-chromium-tungsten alloy powder deposited in inverse order on the titanium alloy steam turbine blade are such that the layer of vanadium formed on the titanium alloy blade has a thickness of 0.5 mm to 1.5 mm and the cobalt-chromium-tungsten alloy layer on said vanadium layer has a thickness of at least 1 mm.

5. A method of laying a protective coating on a steam turbine blade made of a titanium alloy including vanadium, said method comprising the following steps in sequence:

depositing practically pure vanadium powder on a portion of the blade;

raising the temperature of the powder to a temperature slightly greater than the melting point of vanadium;

dropping the temperature;

depositing a powder of a cobalt-chromium-tungsten alloy on the layer of vanadium; and raising this powder to a temperature greater than its melting temperature and less than the melting temperature of vanadium, whereby maximum binding of the protective layer vanadium to the titanium alloy blade occurs with low dilution of the vanadium into the titanium alloy blade substrate giving rise locally to beta structure at the interface therebetween with the diffusion of the cobalt-chromium-tungsten alloy into the protective layer of vanadium being sufficiently limited so as to have no adverse effect on the bond between the vanadium protective layer and the blade substrate such that the resulting blade has very high resistance to abrasion by water under steam turbine operating conditions where the peripheral speed of the titanium alloy blade is high.

6. A method according to claim 1, wherein the temperature of the vanadium and of the cobalt-chromium-tungsten alloy is raised by induction heating using a moving inductor.

7. A method in accordance with claim 1, wherein the quantities of vanadium powder and of cobalt-chromium-tungsten alloy powder deposited in inverse order on the steam turbine blade are such that the layer of vanadium has a thickness of 0.5 mm to 1.5 mm and the cobalt-chromium-tungsten alloy powder forms a layer of at least 1 mm on the layer of vanadium.

* * * * *